US005998927A

United States Patent [19]

Foust et al.

[11] Patent Number: 5,998,927

[45] Date of Patent: Dec. 7, 1999

[54] CONTROL OF LEACHABLE MERCURY IN FLUORESCENT LAMPS BY IRON ADDITION

[75] Inventors: Donald Franklin Foust, Scotia; Deborah Ann Haitko; David Key Dietrich, both of Schenectady, all of N.Y.

[73] Assignee: General Electric Company, Schenectady, N.Y.

[21] Appl. No.: 08/989,681

[22] Filed: Dec. 12, 1997

[51] Int. Cl.[6] ..... H01J 61/00

[52] U.S. Cl. ..... 313/565; 445/2; 313/567

[58] Field of Search ..... 313/565, 567, 313/572, 573; 445/2

[56] References Cited

U.S. PATENT DOCUMENTS

| | | | |
|---|---|---|---|
| 4,929,869 | 5/1990 | Yonezawa et al. | 313/639 |
| 5,229,686 | 7/1993 | Fowler et al. | 313/565 |
| 5,229,687 | 7/1993 | Fowler et al. | 313/565 |
| 5,754,002 | 5/1998 | Haitko et al. | 313/565 |
| 5,777,434 | 7/1998 | Dietrich et al. | 313/565 |
| 5,821,682 | 10/1998 | Foust et al. | 313/318.08 |
| 5,846,109 | 12/1998 | Foust et al. | 445/2 |

*Primary Examiner*—Vip Patel
*Assistant Examiner*—Matthew J. Gerike
*Attorney, Agent, or Firm*—Bernadette M. Bennett; Donald S. Ingraham

[57] ABSTRACT

The formation of leachable mercury upon disposal or during TCLP testing of mercury vapor discharge lamps is substantially prevented by maintaining the amount of elemental iron at a level which is at least about 100 to about 1000 milligrams per kilogram of the total weight of lamp material.

8 Claims, 1 Drawing Sheet

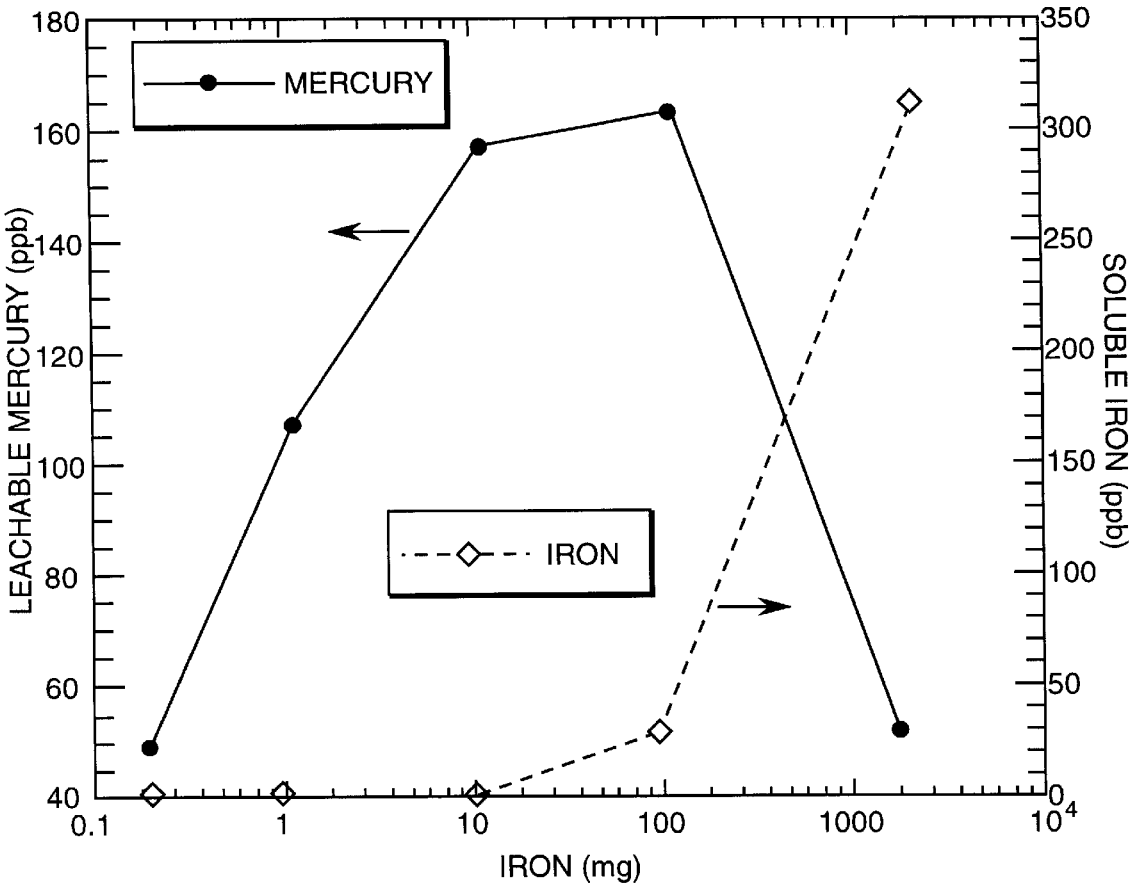
MERCURY
IRON
LEACHABLE MERCURY (ppb)
SOLUBLE IRON (ppb)
IRON (mg)
180
160
140
120
100
80
60
40
350
300
250
200
150
100
50
0
0.1
1
10
100
1000
$10^4$

CONTROL OF LEACHABLE MERCURY IN FLUORESCENT LAMPS BY IRON ADDITION

BACKGROUND OF THE INVENTION

This invention is directed to mercury vapor arc discharge lamps in which the arc discharge takes place in mercury vapor, including conventional phosphor fluorescent lamps and more particularly to avoidance of mercury pollution of landfills and ground eater upon disposal of such lamps and during testing for leaching of toxic materials from such lamps and to prevention of the formation of leachable mercury in disposal and testing procedures. The lamps provided herein are characterized by reduced solubilization and leaching of mercury when the lamp is pulverized for testing or upon disposal.

Low pressure mercury arc discharge lamps are standard lighting means which include electrodes sealed in a glass envelope, the interior of which may be coated with a phosphor. The lamp also contains a small amount of mercury and an inert gas at low pressure, of about 1 to 5 torr. The term lamp, as used herein, means the complete unit including the glass envelope and the end pieces and plugs for mounting in a lamp fixture, and wires which connect the internal components of the envelope with the end pieces.

During manufacture of fluorescent or low pressure mercury arc lamps an amount of elemental mercury ($Hg^0$) is sealed in the lamp envelope. Most of the mercury adheres to the phosphor coating, a small amount being in the vapor phase.

During operation, alkali metal carbonates from the electrodes decompose and form free oxygen in the lamp. The oxygen may react with a portion of the mercury to form soluble mercury oxide (HgO). Soluble mercury oxide is leachable from land fills and other disposal facilities. Soluble mercury oxides or other oxidized forms of mercury formed in the course of the test are detrimental to the accuracy and reliability of the standard test for determination of the leachability of toxic materials from lamp waste. This test is generally referred to as the Toxicity Leaching Characteristic Procedure or TLCP test.

There is concern about the environmental impact of soluble mercury compounds which can leach into ground water sources, rivers, streams, and the like.

BRIEF DESCRIPTION OF THE DRAWING(S)

The invention will become more readily apparent from the following exemplary description in connection with the accompanying drawing, wherein the FIGURE represents graphically the relationship between leachable mercury and soluble iron.

DESCRIPTION OF THE INVENTION

Ferric ions form soluble compounds which are capable of oxidizing elemental mercury to the monovalent, mercurous, form which is soluble in an acidic aqueous environment and therefore leachable. The formation of ferric (Fe+3) compounds depend on elemental iron or Ferrous (Fe+2) iron being exposed to and reacting with oxygen. The presence of oxidizable iron, unexpectedly, has been found to have a significant beneficial effect on the formation of leachable mercury. Elimination of soluble, i.e., leachable, mercury is a desirable result in the TCLP test and for the environment when lamps are disposed of in a landfill.

The formation of leachable mercury when fluorescent lamps are broken and exposed to landfill conditions can be prevented or minimized by preventing oxidation of certain components of the lamp. Certain metal components of fluorescent lamps particularly iron lead wires and any brass components generate ferric ($Fe^{+3}$) ions when exposed to moisture, oxygen, and acidity.

In order to address the growing concern that excessive amounts of mercury from disposal of fluorescent lamps might leach into surface and subsurface bodies of water, the Environmental Protection Agency has established a maximum concentration level for mercury at 0.2 milligrams of leachable mercury per liter. This is generally determined by the standard analysis known as the Toxicity Characteristic Leaching Procedure (TCLP), a well known test procedure.

In carrying of the TCLP test, the lamps are pulverized to form lamp waste material similar to that which would result from lamp disposal in land fills or other disposal locations. The ambient conditions in such locations may be such as to promote formation of leachable mercury just as the TCLP test conditions themselves tend to allow for formation of leachable mercury in amounts greater than the established limit of 0.2 milligrams per liter.

It has been found that elemental mercury added to mercury-free pulverized lamp materials prepared for the TCLP test is converted to leachable mercury in the course of the test. If elemental mercury alone or in combination with various glass, phosphor, or non-metal lamp components is tested, little or essentially no leachable mercury is found. When elemental mercury is tested in combination with metal lamp components such as iron lead wires, pins, or other metal hardware, the mercury is transformed into a leachable form.

It was determined by controlled experimentation that ferric iron (trivalent) is generated under the TCLP test conditions when carried out in the presence of oxygen and that this ionic species is able to oxidize elemental mercury to soluble mercury compounds which are measured as leachable mercury.

Corrosion or dissolution of metals from the metallic state requires the presence of both oxygen and a solvent such as water conditions that exist in the TCLP test and landfill situations. Accordingly, it has been found that the formation can be controlled or prevented by controlling or excluding exposure to oxygen of the iron containing metal lamp components.

The principles and practice of this invention will be more fully understood when considered in view of the following examples.

All TCLP test data was obtained by the test procedure prescribed on pages 26987–26998 volume 55, number 126 of the Jun. 29, 1990 issue of the Federal Register.

Briefly, lamps being tested are pulverized into particulate form having the prescribed particle size which is capable of passing through ⅜ inch sieve. The test material is then extracted wth a sodium acetate-acetic acid buffer at a pH of about 4.93.

To prevent the spurious formation of leachable mercury upon disposal of mercury vapor discharge lamps and to improve the reliability of the TCLP test the formation of soluble iron is controlled by use of iron-free or low iron parts as components for lamp manufacture.

The effect of both soluble iron and copper on the formation of soluble mercury is evident from the data in Table 1, below. As the head space volume(available oxygen) increases, the amount of soluble mercury increases in response to the formation of increasing amounts of soluble iron (ferric) and copper.

TABLE 1

| | Head Space (mL) | Soluble Mercury (ppb) | Soluble Iron (ppm) | Soluble Copper (ppm) |
|---|---|---|---|---|
| 0 | 0.0000 | 210 | 3.62 | 0.35 |
| 1 | 140 | 214 | 4.63 | 0.40 |
| 2 | 205 | 203 | 5.04 | 0.63 |

Table 2, below, shows the effect of iron content on the formation of leachable mercury in the TCLP test procedure described above.

TABLE 2

| Fe mg | Leachable Hg ppm | Soluble Fe ppm |
|---|---|---|
| 0.2000 | 50.000 | 0.50000 |
| 1.1000 | 108.00 | 0.50000 |
| 10.100 | 158.00 | 3.2000 |
| 103.30 | 165.00 | 27.600 |
| 1882.8 | 50.000 | 312.00 |

Increased amounts of iron in a form which can be oxidized to $Fe^{+3}$ have unexpectedly been found to reduce formation of leachable mercury in the TCLP test procedure.

The invention provides a method for controlling the formation of leachable mercury resulting from oxidation of elemental mercury associated with fluorescent lamps of the mercury vapor discharge type. The method for inhibiting the formation of leachable mercury associated with mercury containing fluorescent lamps comprises providing an increased amount of iron over and above the amount usually contained in conventional fluorescent lamps. More specifically, the presence of more than 100 milligrams of oxidizable iron per kilogram of lamp weight has been found to reduce the amount of leachable mercury produced in the TLCP procedure. It is preferred that the amount of such iron be at least about 1000 milligrams (1 gram) per kilogram of lamp material. The term "oxidizable iron", as used herein means iron of any form which can be oxidized to $Fe^{+3}$.

The invention provides for a high iron-content mercury vapor discharge lamp comprising an envelope of light transmitting glass which contains, an inert gas and an amount of elemental mercury, and a pair of electrodes for establishing an arc discharge. The term "high iron content", as used herein, means at least about 1000 milligrams of elemental iron per kilo of total lamp material. As the amount of soluble iron increases above about 1 milligram the amount of leachable mercury increases sharply.

The lamp further comprises at least one metal, possibly an iron-containing alloy, base or end cap which defines a cavity having an inner surface, and which is secured to the lamp envelope by a basing cement. Generally such lamps have a pair of end caps.

In a preferred embodiment of the invention, increased iron content is achieved by replacing iron-free or low-iron components such as the aluminum end caps or brass pins with parts made of iron or alloy which contain a substantial proportion of iron such as tin, nickel, or chromium plated steels. It is necessary that the plating be such that it breaks down under TCLP conditions or in the landfill to expose the iron-containing material thus providing the extra iron for oxidation to $Fe^{+3}$.

The use of high-iron components in a lamp structure appears to favor formation of divalent (ferrous) iron which prevents or reduces oxidation of iron metal to $Fe^{+3}$, a form which is soluble and capable of oxidizing elemental mercury to a soluble form of mercury oxide. Accordingly the formation and dissolution of soluble ferric compounds from the lamp components is diminished or prevented, resulting in reducing or preventing formation of leachable mercury compounds by exposure of insoluble mercury to fully oxidized iron ($Fe^{+3}$).

The unexpected influence of iron content on formation of leachable mercury is shown in Table 2, above and FIG. 1, a graph of the data of Table 2. The method for controlling the formation of leachable mercury associated with mercury containing fluorescent lamps comprises providing an increased amount of oxidizable iron. The presence of more than 100 milligrams of oxidizable iron per kilogram of lamp weight is shown to reduce the amount of leachable mercury produced in the experimental procedure. It is preferred that the amount of such iron be at least about 1000 milligrams (1 gram) per kilogram of lamp material. The term "oxidizable iron", as used herein includes iron of any physical or chemical form which can be oxidized to $Fe^{+3}$.

What is claimed is:

1. A method for inhibiting the formation of leachable mercury associated with a mercury arc vapor discharge lamp, the method comprising providing high-iron content metal components in said lamps, at least one of said high-iron content metal components having an amount of oxidizable iron of at least about 1 gram per kilogram of lamp weight.

2. A method according to claim 1 in which oxidizable iron is any form of iron which favors oxidation to $Fe^{+2}$.

3. A method according to claim 1 in which the amount of oxidizable iron is controlled by using iron components to fabricate mercury containing fluorescent lamps.

4. The method according to claim 1 in which high iron content is achieved by substituting ferrous materials for nonferrous or low iron-containing components.

5. A method according to claim 1, wherein said metal components are selected from the group consisting of end caps, connector pins, and lead wires.

6. A mercury vapor arc discharge lamp comprising high-iron content metal components wherein at least one of said metal components contains oxidizable iron in an amount of at least 1 gram per kilogram of lamp weight.

7. A mercury vapor arc discharge lamp of claim 6 wherein the metal components are selected from the group consisting of lead wires, pins and end caps.

8. A mercury vapor arc discharge lamp of claim 6 wherein the oxidizable iron is any form of iron which favors oxidation to $Fe^{+3}$.

* * * * *